United States Patent [19]

Goines et al.

[11] Patent Number: 4,534,143

[45] Date of Patent: Aug. 13, 1985

[54] SYSTEM FOR CONTROLLING THE MOISTURE IN THE SUBSURFACE SOIL SURROUNDING A BUILDING

[75] Inventors: Fredrick J. Goines, Tulsa; David A. Reifsteck, Muskogee, both of Okla.

[73] Assignee: Midwest Irrigation and Foundation, Inc., Tulsa, Okla.

[21] Appl. No.: 544,717

[22] Filed: Oct. 24, 1983

[51] Int. Cl.[3] ..... E02D 27/00

[52] U.S. Cl. ..... 52/169.5; 52/169.1; 405/36; 405/45; 47/48.5

[58] Field of Search ..... 52/169.1, 169.5, 742, 52/294; 405/36, 43, 44, 45, 46; 47/48.5

[56] References Cited

U.S. PATENT DOCUMENTS

| | | | |
|---|---|---|---|
| 444,564 | 1/1891 | Copeland | 405/43 |
| 584,886 | 6/1897 | Mead | 405/43 |
| 3,046,747 | 7/1962 | Timpe | 405/45 |
| 3,109,258 | 11/1963 | Jensen | 47/48.5 |
| 3,425,175 | 2/1969 | Gerde | 52/169.5 |
| 4,015,432 | 4/1977 | Ball | 52/169.5 |

FOREIGN PATENT DOCUMENTS

| | | | |
|---|---|---|---|
| 21334 | 1/1981 | European Pat. Off. | 405/36 |
| 29400 | 5/1981 | European Pat. Off. | 52/169.5 |

OTHER PUBLICATIONS

"Some Secrets to Building Structures on Expansive Soils" Civil Engineering ASCE, Dec. 1980, pp. 53, 54, 55.

*Primary Examiner*—Henry E. Raduazo
*Attorney, Agent, or Firm*—William S. Dorman

[57] ABSTRACT

Apparatus for controlling the moisture in the ground surrounding a building comprising a circumferential conduit extending around the building approximately ten inches below the ground level and from six to twenty-four inches away from the foundation of the building. The circumferential conduit is composed essentially of porous flexible hose capable of permitting seepage of water from the inside of the hose to the outside thereof through the pores of the hose when water under pressure is fed into the interior of the hose. A supply conduit connects at one end to a water main, and at its other end through an on-off valve, a pair of check valves connected in series, a pressure regulating valve for reducing the pressure from the water main to about 1 to 5 psi, to a terminal conduit for conducting water under 1 to 5 psi into a tee connection in the circumferential conduit. A metering valve is located in the circumferential conduit on each side of the tee and adjacent the tee for controlling the flow of water into each side of the circumferential conduit leading away from the tee. A plurality of vertical hose sections of porous pipe extend downwardly from the circumferential conduit at approximately three feet intervals around the circumference of the circumferential circuit, each vertical hose extending downwardly into the ground from three feet to twenty feet below ground level, the lower end of each vertical hose being closed, the upper end of each vertical hose being open and in communication with the circumferential conduit.

5 Claims, 5 Drawing Figures

SYSTEM FOR CONTROLLING THE MOISTURE IN THE SUBSURFACE SOIL SURROUNDING A BUILDING

BACKGROUND OF THE INVENTION

1. Field of the Invention

The present invention relates to a system for controling the moisture content in the subsurface soil to depths of 20 feet surrounding the foundation of a house or other building structure.

2. Prior Art

The prior art teaches the desirability of attempting to control the moisture content in the surface soil primarily for the purpose of irrigating plant life. However, none of the prior art teaches how to control the moisture content in the earth at subsoil depths up to 20 feet deep surrounding a house or other building structure in order to prevent damage to the foundation as described in the manner herein.

A preliminary patent search was conducted related to the present invention and the following patents were uncovered in the search:

| Inventor | U.S. Pat. No | Date |
|---|---|---|
| Babin | 2,798,768 | July 9, 1957 |
| Thomas | 3,552,654 | January 5, 1971 |
| Cobb et al. | 3,744,256 | July 10, 1973 |
| Fitzhugh | 3,797,738 | March 19, 1974 |
| Chevreliere | 3,905,551 | September 16, 1975 |
| Green | 3,946,762 | March 30, 1976 |
| Maclay | 3,991,939 | November 16, 1976 |
| Neal | 4,197,866 | April 15, 1980 |

Babin U.S. Pat. No. 2,798,768 shows a pipe construction through which liquids can be pumped or flow freely while at the same time allowing small quantities of liquid to be discharged along the length of the pipe. The pipe construction of Babin may be positioned above ground, on the ground, or beneath the ground. This patent is directed to the irrigation of plant life.

Thomas U.S. Pat. No. 3,552,654 shows irrigation or soaking conduits composed of an outer skin which is substantially impervious to water and which is prepared with score lines thereby destroying the water-impervious nature and thus permitting water to seep from the conduit and irrigate or soak plant life in the soil.

Cobb et al. U.S. Pat. No. 3,744,256 shows an irrigation system which provides a continuous supply of fluid from a supply reservoir through a ring system or by gravity flow with varying degrees of porosity in a sealed-end system. This system is not pressurized or monitored with any type of metering device thereby providing unbalanced, continuous irrigation at all times with no shut-off controls.

Fitzhugh U.S. Pat. No. 3,797,738 shows a method for sub-surface drip soil irrigation of arid areas of land of varying sizes by providing wick manifolds which would randomly distribute water on a continuous basis regardless of the terrain or land leveling procedures.

Ayme de la Chevreliere U.S. Pat. No. 3,905,551 shows an automatic, above-ground sprinkling control mechanism which provides water to the earth after being signaled to do so by upper and lower placed, in-ground, soil electrodes.

Green U.S. Pat. No. 3,946,762 shows an irrigation or drainage system comprising one or more conduits having a mesh fabric sheath covering radially spaced apertures which, due to capillary action, permit uniform fluid distribution throughout the length of the sheath and the peripheral surrounding area Maclay U.S. Pat. No. 3,991,939 shows an automated above-ground misting and cooling sprinkler system for use with ornamental and food-producing plants, shrubs, and crops not only to irrigate leaves and roots, but also to provide protection against damage to leaves by insects and heat.

Neal U.S. Pat. No. 4,197,866 shows a soil moisture sampler and control mechanism which automatically activates in-ground probes which measure moisture and, when less than a pre-set value, signal an irrigation timer to activate thus irrigating the soil for a preselected time interval. This system discloses a somewhat complicated electronic control circuit which is employed principally in the irrigation of fields and orchards.

The present invention relates to a system for a controlled distribution of water for the purpose of moistening the soil surrounding the foundation of a house or other building structure down to twenty feet and is directed to solving the problem of water distribution in such soil. The shrinking or swelling of subsurface soil has inflicted billions of dollars in damage to houses and buildings each year and has presented a monumental problem to owners who are directly affected. Because of these problems much work has gone into the development of a moisture distribution system which will specifically irrigate the earth surrounding a house or other building structure.

The present invention has been developed to specifically control the behavior and degree of moisture below ground. Subsurface water can be divided into two general classifications: the aeration zone and the saturation zone. The latter, more commonly termed the "water table," is the deepest level. The aeration zone includes a capillary fringe area which obtains moisture from the water table, an intermediate belt which contains moisture in dead storage such as one might find after a good rainstorm, and at the surface, the soil water belt which provides moisture for vegetable and plant roots.

Unless the soil water belt can replace capillary water usually provided by surface watering or rain showers, the soil will eventually dessicate through the effects of gravity, transpiration, and evaporation. In so doing, capillary water is lost—a critical factor which influences building foundations and their stability. Since the water content of the surface soil tends to remain relatively stable below very shallow depths, and since the availability of soil water derived from a water table ceases when the boundary lies at a depth exceeding the limit of capillary rise for a particular type soil, (from six inches to depths approaching twenty feet), it is the soil water belt and the uppermost portion of the intermediate belt which receive benefits from this invention.

Factors influencing foundation stability include: (1) soil content, (2) the moisture zone, and (3) vegetation present. Soil content can be coarse, i.e. gravels and sands, or fine, i.e. silts and clays. However, what accounts for more economic damage to structures than any other thing is the problem arising from the moisture content in partially saturated soils regardless of composition because only partially saturated soils can swell or shrink. Therefore, only water which penetrates these soils is of particular concern with respect to foundation stability. Variations in moisture within these expansive soils cause most foundation failures. These soils swell when wet causing upheaval and shrink when dry causing settlement. Any volumetric changes in the soil bearing the weight of the foundation causes differential foundation movement.

All types of soils can cause problems, but one type seems to be the most common offender—clay. Clay soils, which have a greater tendency for runoff as opposed to infiltration than do sandy soils, can be expansive when three conditions are met: (1) the soil contains the type of clay mineral subject to high volume change with increased moisture change; (2) the soil has been in a dessicated condition for at least part of the seasonal cycle; and (3) the strata containing the expansive clay mineral must be sufficiently thick to create significant movement.

The invention herein described would provide moisture to the soil water belt, the zone which affects foundation behavior the most and the intermediate belt which supports the aforementioned. The system would make available constant moisture which is necessary for foundation safety. The water table would have little, if any significant influence on soil moisture since all soils have an equilibrium moisture content dictated by gravity acting against forces holding water in the soil. This equilibrium would change in the upper or aeration zone because water is removed by one or a combination of three processes: transpiration (removal by vegetation), evaporation (removal into the air), and gravity (removal by a downward pull).

Loss of soil moisture beneath a foundation caused by evaporation would show the greatest effects closer to the surface. In exposed soil, evaporation forces are everpresent as long as atmospheric humidity is less than 100 percent. Clay soil under the confines of a slab foundation can be readily saturated by water injections; however, a natural tendency persists for moisture to migrate laterally as well as distally thereby escaping at the periphery. The installation of a vertical water barrier around a foundation perimeter would retard this natural water loss although it must be realized that the loss cannot be completely stopped. However, in the upper strata, a fluctuating condition can arise due to seasonal effects and to the forces of gravity whether the soil is covered or exposed. Therefore, construction design, i.e. slab versus crawl space, is not a critical factor because moisture content below a slab foundation tends to be higher than in surrounding exposed areas.

SUMMARY OF THE INVENTION

The present invention discloses systems for controlling the moisture content in the subsurface soil to depths of 20 feet surrounding the foundation of a house or other building structure. The disclosure includes two different possible types of system installations, one system preferably to be installed during the construction of a new building, and the other preferred system to be installed around the foundation of a new building or a pre-existing building.

The preferred embodiment of the present invention includes a ring consisting of end-to-end sections of porous pipe (sometimes referred to as "leaky" pipe) laid circumferentially around the foundation of a new or existing building approximately ten inches below ground level. "Leaky" pipe can be described as a porous, flexible, cylindrical hose manufactured from rubber or rubber particles in such a manner that the final porous pipe product will permit seepage of water through the pores of the hose when the water in the hose is placed under pressure. The ring is preferably placed from six to twenty-four inches away from the foundation system of the building depending on the compression factor of the soil.

Between certain adjacent sections of porous pipe are standard plastic tees (of the type normally employed to connect three hoses together) whose horizontal arms extend into the adjacent sections but whose vertical leg connects with a vertical section of porous pipe. The tees, and hence the vertical pipes, are preferably spaced approximately three feet apart. Each vertical section of porous pipe is closed at its lower end but open at its upper end where it fits over the downwardly extending leg of the tee. Depth of these vertical pipes may extend down to twenty feet and must be individually determined by soil core tests at each installation location.

At certain locations along the ring, metering devices or control valves are interposed between adjacent sections of porous pipe. Each metering device has associated therewith a vertical access pipe or tube, preferably of PVC pipe, which extends upwards from the metering device through the soil to the surface. The lower end of this pipe fits over an upwardly projecting leg of the metering valve and the inner diameter of the access pipe is of sufficient size so as to permit adjustments to be made on the metering valve by the insertion of a long-handled screw driver.

The invention also discloses a preferable conduit circuit for the controlled distribution of water from a main line around a foundation of a house or other building. Preferably, the main line to the building is broken into in the area of the water meter and the main shutoff valve by a suitable tee connection. From this tee, a source of water is supplied to the ring surrounding the building through a series of interconnected PVC pipe and fittings and valves. The PVC pipe connects from the tee to a main shutoff valve, a pair of check valves arranged in series, through a pressure reducing valve and to a tee which connects with the ring. The pressure reducing valve reduces the pressure from the main line pressure to a pressure of about 1 to 5 psi on the outlet side of the valve, preferably about 2 psi.

Immediately beyond the last mentioned tee, the circuit connects with a pair of porous pipe sections going in opposite directions around the ring. A pair of metering valves (as described above) are located on opposite sides of the tee between the first and second sections of porous pipe away from the tee. After the system has been installed, these first two metering valves will be adjusted to minimize flooding and to equalize the flow in the two divergent branches of the ring. In the event that localized flooding occurs at any location around the ring (after installation), a vertical hole is dug in the ground on the upstream side of the flooding down to the ring; the porous pipe section at this point is cut and another metering valve is inserted.

The other system of the present invention includes an upper porous pipe which constitutes the upper portion of an entire circuit which is laid at two different levels circumferentially around the foundation of a house or other building structure. This circuit which connects with the main supply (in the same manner as described above) will permit controlled amounts of seepage at various locations therethrough. The upper porous pipe is to be placed ten inches below the ground level and from six to twenty-four inches away from the foundation system of the new building depending on the compression factor of the soil. A lower porous pipe (of the same size and type as the upper pipe), forming the lower portion of the circuit, is placed horizontally at approximately two inches below the bottom of the footing (generally about three and one-half to four feet below ground level) and from six to twenty-four inches away from the foundation of the newly constructed building and is connected to the upper porous pipe in any convenient manner such as by a pair of tees and an interconnecting section of porous pipe; alternatively, the lower porous pipe can be connected directly to the same main source of water supply for the upper porous pipe so that, in either event, there is a continuous circumferential circuit at both levels.

The pressure reduction provided by the pressure reducing valve is important to the operation of the flow circuit. With the use of this low pressure it has been discovered that sophisticated sensors and automatic controls for valves can be eliminated. The "pressure" of the earth surrounding the porous pipe will control the flow. If, for example, the earth surrounding the porous pipe should become relatively dry, the resistance to flow of water into this "dry" soil would be at a minimum and the flow out of the porous pipe would be at its maximum; however, as the soil becomes saturated, the resistance to water flow into the moist soil increases and the flow out of the porous decreases accordingly until the soil and the flow out of the porous pipe reach equilibrium at which time the flow out of the porous pipe becomes very small. The intended purpose of the present invention would be to maintain a constant moisture level which would keep the soil between the states of total dehydration and complete saturation thereby stabilizing the foundation.

DETAILED DESCRIPTION OF THE PREFERRED EMBODIMENTS

Figure 1:
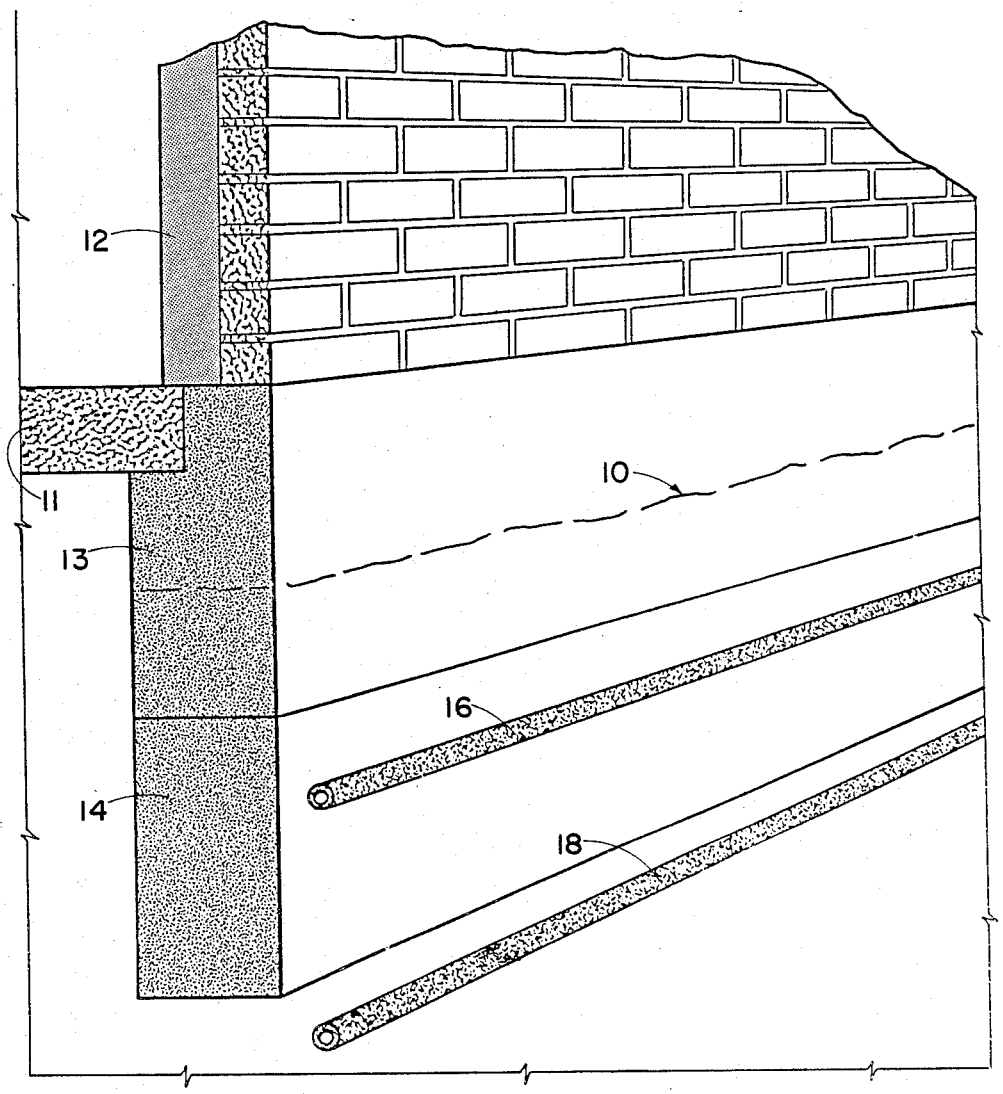
FIG. 1 is a perspective view, with an end portion in section and with other portions being broken away, of the foundation of a house of slab-type construction showing the moisture control system in accordance with one embodiment of the present invention as installed in the ground surrounding the foundation of the house contemporaneous with the construction thereof.
Figure 2:
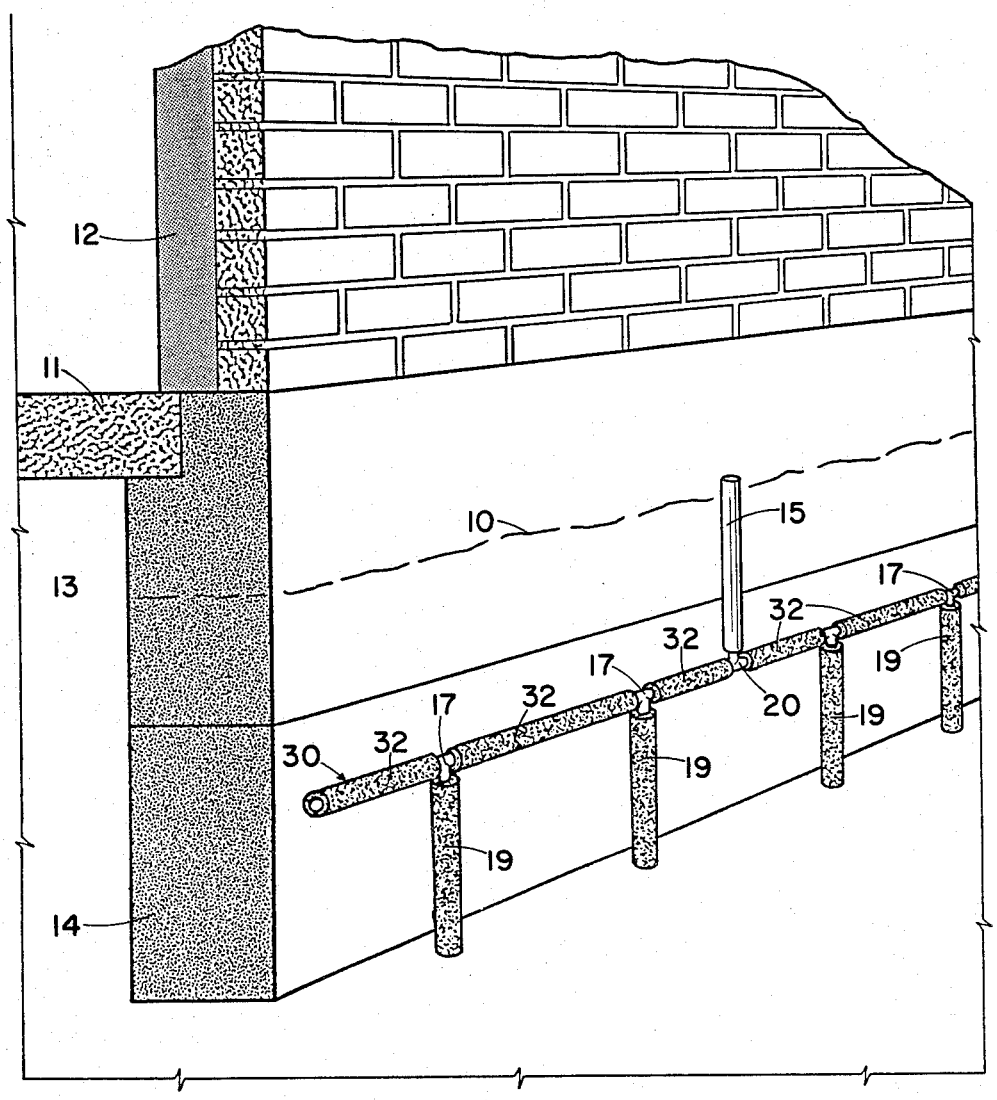
FIG. 2 is a view similar to FIG. 1 showing the moisture control system in accordance with the preferred embodiment of the present invention as installed in a pre-existing house of the same design.

Referring to the drawings in detail, FIGS. 1 and 2 show two different possible types of system installations, FIG. 1 describing a system to be installed during the construction of a new building, and FIG. 2 describing a system to be installed, by way of example only, around the foundation of a preexisting building.

FIG. 1 shows the ground level 10 and the slab 11 of the foundation. An upper wall 12 of the outside of the building is shown as extending above the ground level while a stemwall 13 is partially above and partially below ground level, and a footing 14 extends below the level of the ground. An upper pipe 16 (sometimes referred to herein as a "leaky" pipe) of porous material and constructed so that water will pass therethrough constitutes the upper portion of an entire circuit which is laid at two different levels circumferentially around the foundation of a house or other building structure. This circuit which connects with a main water supply (in a manner later to be described) will permit controlled amounts of seepage at various locations therethrough. "Leaky" pipe can be described as a porous, flexible, cylindrical hose manufactured from rubber or rubber particles in such a manner that the final porous pipe product will permit seepage of water through the pores of the hose when the water in the hose is placed under pressure. Where the term "porous pipe" is used in this description, it is intended to cover any other porous flexible hose which permits seepage of water through the pores of the hose when the water therein is placed under pressure. In the present design, for purposes of explanation and not by way of limitation, we prefer to employ porous pipe having an outside diameter of one inch and an inside diameter of three fourths inch. The upper porous pipe 16 is to be placed ten inches below the ground level 10 and from six to twenty-four inches away from the foundation system of the new building depending on the compression factor of the soil.

A lower porous pipe 18 (of the same size and type as the pipe 16), forming the lower portion of the circuit, is placed horizontally at approximately two inches below the bottom of the footing 14 (generally about three and one-half to four feet below ground level) and from six to twenty-four inches away from the foundation of the newly constructed building and is connected to the porous pipe 16 in any convenient manner such as by a pair of tees (not shown) and an interconnecting section of porous pipe (not shown); alternatively, the porous pipe 18 can be connected directly to the same main source of water supply for the porous pipe 16 so that, in either event, there is a continuous circumferential circuit at both levels.

Figure 4:
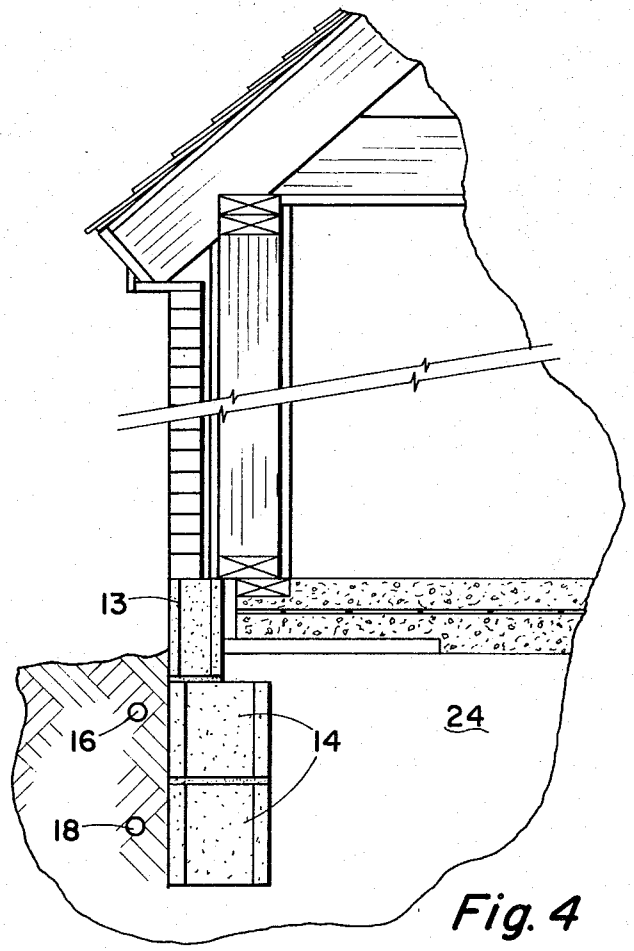
FIG. 4 is a view similar to FIG. 3 but where the house is provided with a crawl space.
Figure 3:
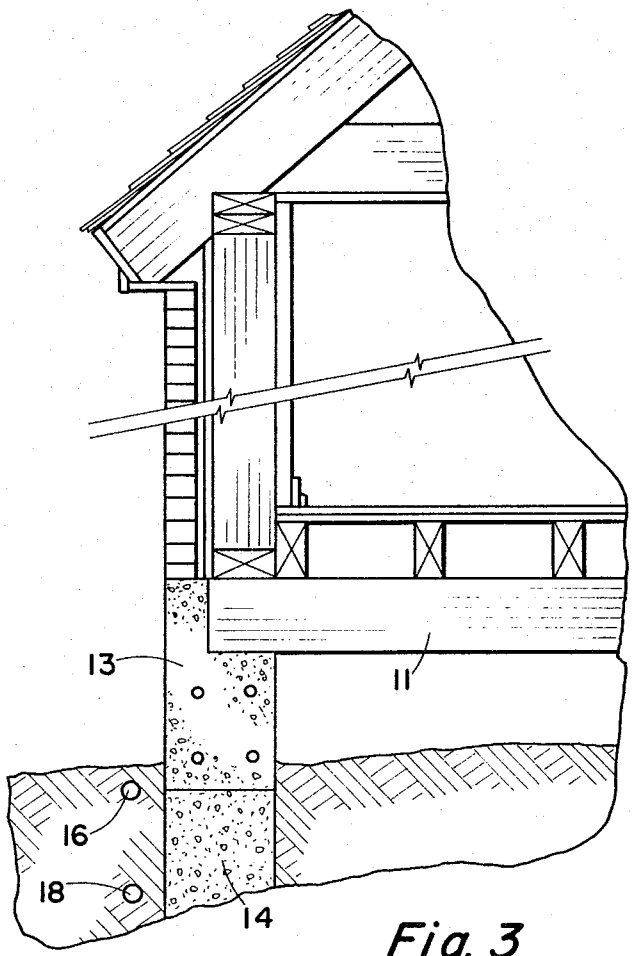
FIG. 3 is a vertical cross-sectional view through a portion of a house and its foundation and showing essentially the same elements shown in FIG. 1.

FIGS. 3 and 4, which illustrate a vertical cross sectional view through a portion of a house and foundation of pier and beam construction design, show essentially the same elements as in FIG. 1 except for FIG. 4 where the house is provided with a crawl space type foundation 24. The ends of the upper ring of porous pipe 16 and the lower ring of porous pipe 18 are shown with respect to the foundation.

Referring to FIG. 2, which illustrates a preferred embodiment of the present invention, a pre-existing building is shown of slab-type construction with the ground level 10 and the slab 11 of the foundation. The upper wall, stemwall, and footing are as described above. An upper (only) ring 30 consisting of end-to-end sections of porous pipe 32 is laid circumferentially around the foundation of the existing building as shown approximately ten inches below ground level. The ring 30 is preferably placed from six to twenty-four inches away from the foundation system of the building depending on the compression factor of the soil. Although reference is made to a pre-existing building, purely by way of example, it should be understood that the system of FIG. 2 can be applied to a building of new construction contemporaneous with its erection.

Between certain adjacent sections 32 are standard plastic tees 17 (of the type normally employed to connect three hoses together) whose horizontal arms extend into the adjacent sections 32 but whose vertical leg connects with a vertical section of porous pipe 19. The tees 17, and hence the vertical pipes 19, are preferably spaced approximately three feet apart. Each vertical section 19 of porous pipe is closed at its lower end but open at its upper end where it fits over the downwardly extending leg of the tee 17. Depth of these vertical pipes 19 may extend down to twenty feet and must be individually determined by soil core tests at each installation location.

At certain locations along the ring 30 (as will be described hereinafter) metering devices or control valves 20 are interposed between adjacent sections 32 of porous pipe. Almost any type of variable orifice or variable flow valve could be used as a control valve 20. Purely for the purposes of complete explanation, the control valve 20 consists of T-shaped body whose opposite arms fit into adjacent sections of porous pipe 32 forming the ring 30. The upwardly directed leg of the valve 20, which is at right angles to the arms previously described, receives a rotatable member (not shown) whose upper projecting end is provided with a slot for the insertion of the end of a long handled screw driver as indicated below. The rotatable member (not shown) is in the form of a cylindrical body threadedly mounted in the body of the valve 20 such that rotation of this cylindrical body by the screw driver will cause the cylinder to move downwardly across the through-bore of the valve to block off the bore to a degree commensurate with the turning of this cylindrical member. A shallow cylindrical seat (not shown) in the body of the valve 20 opposite from the slotted end of the cylindrical body is adapted to receive the lower end of the cylindrical body for a completely closed position of the valve 20. Each metering device has associated therewith a vertical access pipe or tube 15, preferably of PVC pipe, which extends upwards from the metering device through the soil to the surface. The lower end of this pipe fits over the upwardly projecting leg of the valve 20 and the inner diameter of the access pipe 15 is of sufficient size so as to permit adjustments to be made on the upper slotted end of the rotatable cylindrical body by the insertion of a long-handled screw driver. The upper end of the access pipe 15 is preferably covered by a removable cap (not shown) to prevent dirt from filling the pipe.

Figure 5:
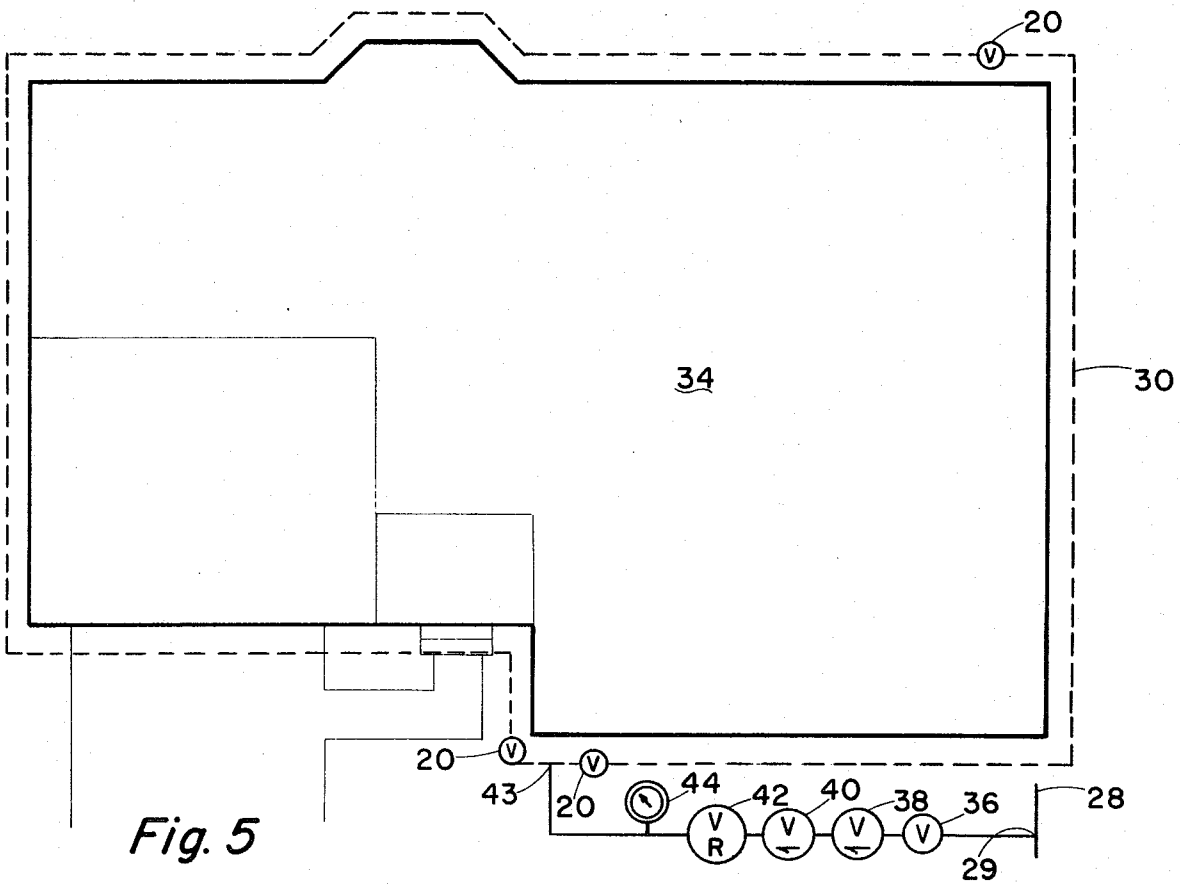
FIG. 5 suggests a possible conduit circuit for the controlled distribution of water from a main line and around the foundation of a house or other building structure.

The diagrammatic representation of FIG. 5 suggests a preferable conduit circuit for the controlled distribution of water from a main line 28 around a foundation of a house 34 or other building. Preferably, the main line to the building is broken into in the area of the water meter and the main shutoff valve (neither shown) by a suitable tee connection 29. From this tee, a source of water is supplied to the ring 30 surrounding the building through a series of inter connected PVC pipe and fittings (not referenced) and valves, now to be described. The first piece of PVC pipe, constituting a supply conduit, connects from the tee 29 to the inlet of a main shutoff valve 36 whose outlet, in turn, connects with a pair of check valves 38 and 40 (as required by most codes) arranged in series as shown. A pressure reducing valve 42 is connected to the downstream side of the series connected check valves. A terminal conduit of PVC pipe connects from the outlet of the pressure reducing valve 42 to a tee 43 which connects with the ring 30. The pressure reducing valve 42 reduces the pressure from the main line pressure to a pressure of about 1 to 5 psi on the outlet side of the valve, preferably about 2 psi. A guage 44 is connected to the outlet side of the valve 42 to indicate and verify the required pressure. Any suitable pressure reducing valve, such as a needle valve, can be employed as the pressure reducing valve 42.

Immediately beyond the tee 43, the circuit connects (or continues) with a pair of porous pipe sections 32 going in opposite directions around the ring 30. As best shown in FIG. 5, a pair of valves 20 (as described above) are located on opposite sides of the tee 43 between the first and second sections of porous pipe away from the tee. After the system has been installed, these first two valves 20 will be adjusted to minimize flooding and to equalize the flow in the two divergent branches of the ring 30. In the event that localized flooding occurs at any location around the ring 30 (after installation), a vertical hole is bored in the ground on the upstream side of the flooding down to the ring 30; the porous pipe section at this point is cut and a valve 20 is inserted, as represented by the "rear" valve 20 in FIG. 5. It should be pointed out that the circuit will always require the first two valves 20 described above, namely the two valves 20 located adjacent the inlet tee 43; as to any additional valves 20 which may be required, this will have to be determined empirically based upon the discovery of locations of flooding. It has been observed that flooding frequently occurs in the regions of slopes.

The pressure reduction provided by the valve 42 is important to the operation of the flow circuit. With the use of this low pressure it has been discovered that sophisticated sensors and automatic controls for valves can be eliminated. Static pressure created by the water in the surrounding soil and the "pressure" of the earth surrounding the porous pipe will control the flow. If, for example, the earth surrounding the porous pipe should become relatively dry, the resistance to flow of water into this "dry" soil would be at a minimum and the flow out of the porous pipe would be at its maximum; however, as the soil becomes saturated, the resistance to water flow into the moist soil increases and the flow out of the porous pipe decreases accordingly until the soil and the flow out of the porous pipe reach equilibrium at which time the flow out of the porous pipe becomes very small. The intended purpose of the present invention would be to maintain a constant moisture level in the soil.

Although the circuit of FIG. 5 has been described in particular relation to the embodiment shown in FIG. 2, it should be understood that a similar arrangement would be required for the circuit to FIGS. 1, 3 and 4. The ring 30 shown in FIG. 5 would be replaced by upper and lower porous pipes 16 and 18. A tee, such as the tee 43, would be required for each level to connect with the main water supply condit 28. The same valves 36, 38, 40 and 42 would be required; the first two valves 20 would be required on either side of the tee 43 on upper level 16. As to any additional valves 20 which might be required on level 16, this would have to be determined empirically in the same manner as discussed above.

Whereas the present invention has been described in particular relation to the drawings attached hereto, it should be understood that other and further modifications, apart from those shown or suggested herein, may be made within the spirit and scope of this invention.

What is claimed is:

1. Apparatus for controling the moisture in the ground surrounding a building which comprises a first circumferential conduit extending around the building approximately ten inches below the ground level and from six to twenty-four inches away from the foundation of the building, the major portion of said first circumferential conduit being composed of porous flexible hose capable of permitting seepage of water from the inside of the hose to the outside thereof through the pores of the hose when water under pressure is fed into the interior of the hose, a supply conduit having an inlet end and an outlet end, the inlet end of the supply conduit being connected to a water main, an on-off valve having an inlet and an outlet, the inlet to the on-off valve being connected to the outlet of the supply conduit, a pair of check valves connected in series to the outlet of the on-off valve, a pressure regulating valve connected to the downstream side of the series-connected check valves for reducing the pressure from the water main to about 1 to 5 psi, a terminal conduit connected to the pressure regulator valve for conducting water under 1 to 5 psi to the circumferential conduit, the terminal conduit connecting to the circumferential conduit through a tee connection, a metering valve located in the circumferential conduit on each side of the tee and adjacent the tee for controlling the flow of water into each side of the circumferential conduit leading away from the tee whereby said circumferential conduit presents a controlled water seepage zone at a level of about ten inches below the ground, a second water seepage zone disposed below said first zone and formed in part at least from porous flexible hose of the type described herein, said second zone being in fluid communication with said first zone.

2. Apparatus for controlling the moisture in the ground surrounding a building as set forth in claim 1 wherein said second zone is provided by a second circumferential conduit disposed directly below said first circumferential conduit about four feet below the ground level, the majority of said second circumferential conduit being composed of porous flexible hose of the type described herein.

3. Apparatus for controling the moisture in the ground surrounding a building as set forth in claim 1 wherein said second zone is established by providing vertical sections of porous flexible hose extending downwardly from said first circumferential conduit at approximately three feet intervals around the circumference of said first circumferential conduit, each vertical hose extending downwardly into the ground from three feet to twenty feet below ground level, the lower end of each vertical hose being closed, the upper end of each vertical hose being open and in communication with said first circumferential conduit.

4. Apparatus for controling the moisture in the ground surrounding a building as set forth in claim 3 wherein at least one additional metering valve is located along said first circumferential conduit spaced from the metering valves positioned adjacent said tee for controling localized flooding.

5. Apparatus for controling the moisture in the ground surrounding a building which comprises a first circumferential conduit extending around the building approximately ten inches below the ground level and from six to twenty-four inches away from the foundation of the building, the major portion of said first circumferential conduit being composed of porous flexible hose capable of permitting seepage of water from the inside of the hose to the outside thereof through the pores of the hose when water under pressure is fed into the interior of the hose, a supply conduit having an inlet end and an outlet end, the inlet end of the supply conduit being connected to a water main, an on-off valve having an inlet and an outlet, the inlet to the on-off valve being connected to the outlet of the supply conduit, a pair of check valves connected in series to the outlet of the on-off valve, a pressure regulating valve connected to the downstream side of the series-connected check valves for reducing the pressure from the water main to about 1 to 5 psi, a terminal conduit connected to the pressure regulator valve for conducting water under 1 to 5 psi to the circumferential conduit, the terminal conduit connecting to the circumferential conduit through a tee connection, a metering valve located in the circumferential conduit on each side of the tee and adjacent the tee for controlling the flow of water into each side of the circumferential conduit leading away from the tee, a plurality of vertical sections of porous flexible hose of the type described herein extending downwardly from said first circumferential conduit at approximately three feet intervals around the circumference of said first circumferential conduit, each vertical hose extending downwardly into the ground from three feet to twenty feet below ground level, the lower end of each vertical hose being closed, the upper end of each vertical hose being open and in communication with said first circumferential conduit.

* * * * *